US008172078B1

(12) United States Patent
Vogel

(10) Patent No.: US 8,172,078 B1
(45) Date of Patent: May 8, 2012

(54) SOLID AND LIQUID SEPARATING DEVICE

(76) Inventor: Jeffrey S. Vogel, Milwaukee, WI (US)

( * ) Notice: Subject to any disclaimer, the term of this patent is extended or adjusted under 35 U.S.C. 154(b) by 407 days.

(21) Appl. No.: 12/614,972

(22) Filed: Nov. 9, 2009

Related U.S. Application Data

(60) Provisional application No. 61/199,352, filed on Nov. 15, 2008.

(51) Int. Cl.
*B65D 25/08* (2006.01)

(52) U.S. Cl. ..... 206/219; 426/120

(58) Field of Classification Search ..... 206/219, 206/220, 221; 426/115, 120, 394, 119
See application file for complete search history.

(56) References Cited

U.S. PATENT DOCUMENTS

| | | | | |
|---|---|---|---|---|
| 4,986,433 | A | 1/1991 | Davis | |
| 5,209,348 | A | 5/1993 | Schafer, III | |
| 5,341,953 | A | 8/1994 | Forester | |
| 5,676,244 | A * | 10/1997 | Green et al. | 206/221 |
| 5,676,275 | A | 10/1997 | Khattar | |
| 5,927,538 | A | 7/1999 | Collins | |
| 6,042,858 | A * | 3/2000 | Kairys | 426/119 |
| 7,523,823 | B1 * | 4/2009 | Bednar | 206/222 |
| 7,874,449 | B1 * | 1/2011 | Studee et al. | 220/502 |
| 2005/0016874 | A1 * | 1/2005 | Serra Galdos | 206/219 |
| 2009/0311389 | A1 * | 12/2009 | Zoss et al. | 426/120 |
| 2010/0116698 | A1 * | 5/2010 | Sudhakar et al. | 206/219 |

* cited by examiner

*Primary Examiner* — Jacob K Ackun
(74) *Attorney, Agent, or Firm* — Donald J. Ersler

(57) ABSTRACT

A solid and liquid separating device includes an inner container and an outer container. The outer container is sized to receive the inner container. The inner container retains solids. The inner container includes an open bottom that is covered by liquid permeable membrane. The liquid permeable membrane is preferably stretchable. The outer container is filled with a liquid. The inner container floats on a top of the liquid in the outer container. A utensil (such as a spoon) is inserted into the solids and pressed into a portion of the liquid permeable membrane. The liquid permeable membrane stretches and allows liquid to enter the inner container. The liquid combines with the solids in the inner container. When the utensil is withdrawn from the liquid permeable membrane, the liquid no longer enters the inner container. The inner container now floats on the liquid in the outer container.

19 Claims, 5 Drawing Sheets

20

20

24
19
2D
26
28
20
2D 22
20

30
32
20

SOLID AND LIQUID SEPARATING DEVICE

CROSS-REFERENCES TO RELATED APPLICATIONS

This is a nonprovisional patent application taking priority from provisional application No. 61/199,352 filed on Nov. 15, 2008.

BACKGROUND OF THE INVENTION

1. Field of the Invention

The present invention relates generally relates to combining solids and a liquid and more specifically to a solid and liquid separating device that keeps solids separate from a liquid, until thereof is ready to be combined.

2. Discussion of the Prior Art

Many people enjoy eating solid foods surrounded by or immersed in liquid. Some of these foods include cereal and milk, pudding with milk, or other possible combinations. Over the years it has been common practice to combine these items resulting in soggy cereal or runny pudding.

As time passed, several attempts were made to lessen these problems. U.S. Pat. No. 5,676,275 to Khattar discloses a bowl within a bowl comprised of threads and a plurality of holes. This device is expensive to manufacture because of the intricate threads and holes. Eating from this bowl is more difficult than eating from a traditional cereal bowl. The hand must go through twice as many motions before eating a spoonful of cereal. First the cereal must be gathered onto the spoon, then it must be dipped into the milk, all before the first taste. This takes extra time and effort. If any cereal falls off the spoon into the milk, it quickly gets soggy. For full consumption of milk, this bowl needs to be tipped as the level of milk reduces. Too much cereal may then fall too quickly into the milk, resulting in soggy cereal.

The next two patents share similar problems with each other. U.S. Pat. No. 5,927,538 to Collins shows a bowl with three chambers, one for dry cereal, one for milk, and the other for combining the two. U.S. Pat. No. 5,341,953 to Forester shows a bowl with a sloped bottom and a separation barrier in the middle. These bowls also require first dipping into the cereal, then dipping into the milk, all before eating. There is also the risk that cereal may fall off the spoon into the milk, where it will immediately begin to get soggy. This means that soggy cereal still remains a problem. Filling these bowls requires extra care so there is no spill over into other sections. These problems cause time loss and hassle.

Another U.S. Pat. No. 5,209,348 to Shafer, III shows a bowl containing separate cereal and milk compartments side by side. A valve permits the cereal and milk to combine. This allows the cereal to immediately begin to get soggy. U.S. Pat. No. 4,986,433 to Davis shows a weighted bowl with a slide angling upward, connecting to a second bowl. The cereal is poured into the upper bowl and the milk into the lower. Cereal is then pushed from the upper bowl to the lower bowl, which holds the milk. Soggy cereal will occur if all of it is not scooped up quickly. This bowl is awkward. If it gets bumped, things could get messy, because of its extra weight, this bowl could cause bodily injury if dropped or mishandled.

Accordingly, there is a clearly felt need in the art for a solid and liquid separating device, which includes a first container of solids that may be temporarily moistened by liquid in a second container by depressing a bottom of the first container.

SUMMARY OF THE INVENTION

The present invention provides a solid and liquid separating device that keeps solids separate from a liquid, until thereof is ready to be combined. A solid and liquid separating device includes an inner container and an outer container. The outer container is sized to receive an outer perimeter of the inner container. The inner container retains solids. The inner container includes an open bottom that is covered by liquid permeable membrane. The liquid permeable membrane is preferably stretchable. The outer container is filled with a liquid. The inner container floats on a top of the liquid in the outer container. A utensil (such as a spoon) is inserted into the solids and pressed into a portion of the liquid permeable membrane. The liquid permeable membrane stretches and allows liquid to enter the inner container. The liquid combines with the solids in the inner container. When the utensil is withdrawn from the liquid permeable membrane, the liquid no longer enters the inner container. The inner container now floats on the liquid in the outer container. The outer container preferably includes a recessed portion for allowing liquid to pool at a bottom thereof to ensure that all the liquid may be accessed.

Accordingly, it is an object of the present invention to provide a solid and liquid separating device, which includes a first container of solids that may be temporarily moistened by liquid in a second container by depressing a bottom of the first container.

These and additional objects, advantages, features and benefits of the present invention will become apparent from the following specification.

DETAILED DESCRIPTION OF THE PREFERRED EMBODIMENTS

Figure 1E:
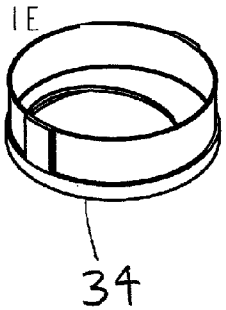
FIG. 1E is a perspective view of an inner container of a solid and liquid separating device in accordance with the present invention.
Figure 1D:
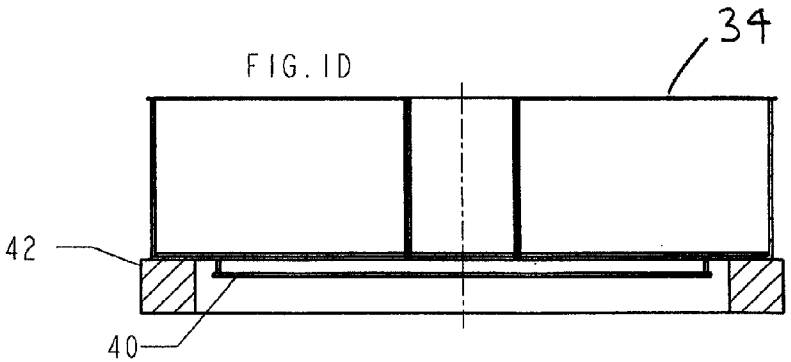
FIG. 1D is a cross sectional side view of an inner container of a solid and liquid separating device cut through FIG. 1A in accordance with the present invention.
Figure 1A:
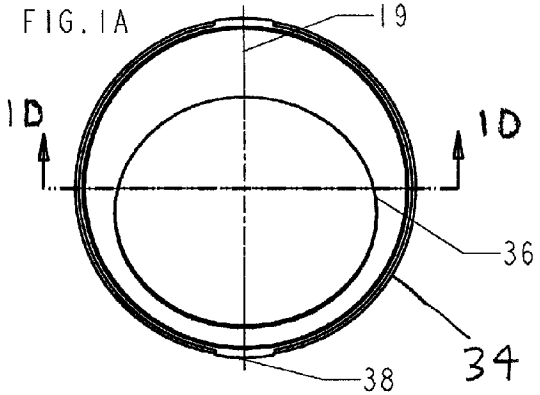
FIG. 1A is a top view of an inner container of a solid and liquid separating device in accordance with the present invention.
Figure 1B:
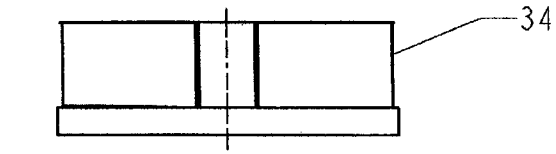
FIG. 1B is a front view of an inner container of a solid and liquid separating device in accordance with the present invention.
Figure 1C:
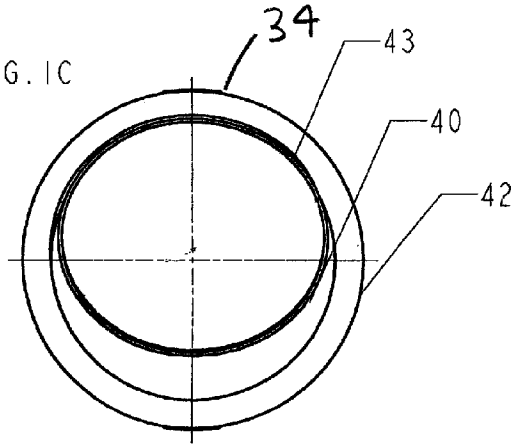
FIG. 1C is a bottom view of an inner container of a solid and liquid separating device in accordance with the present invention.
Figures 2A, 2B, 2C, 2D, 2E:
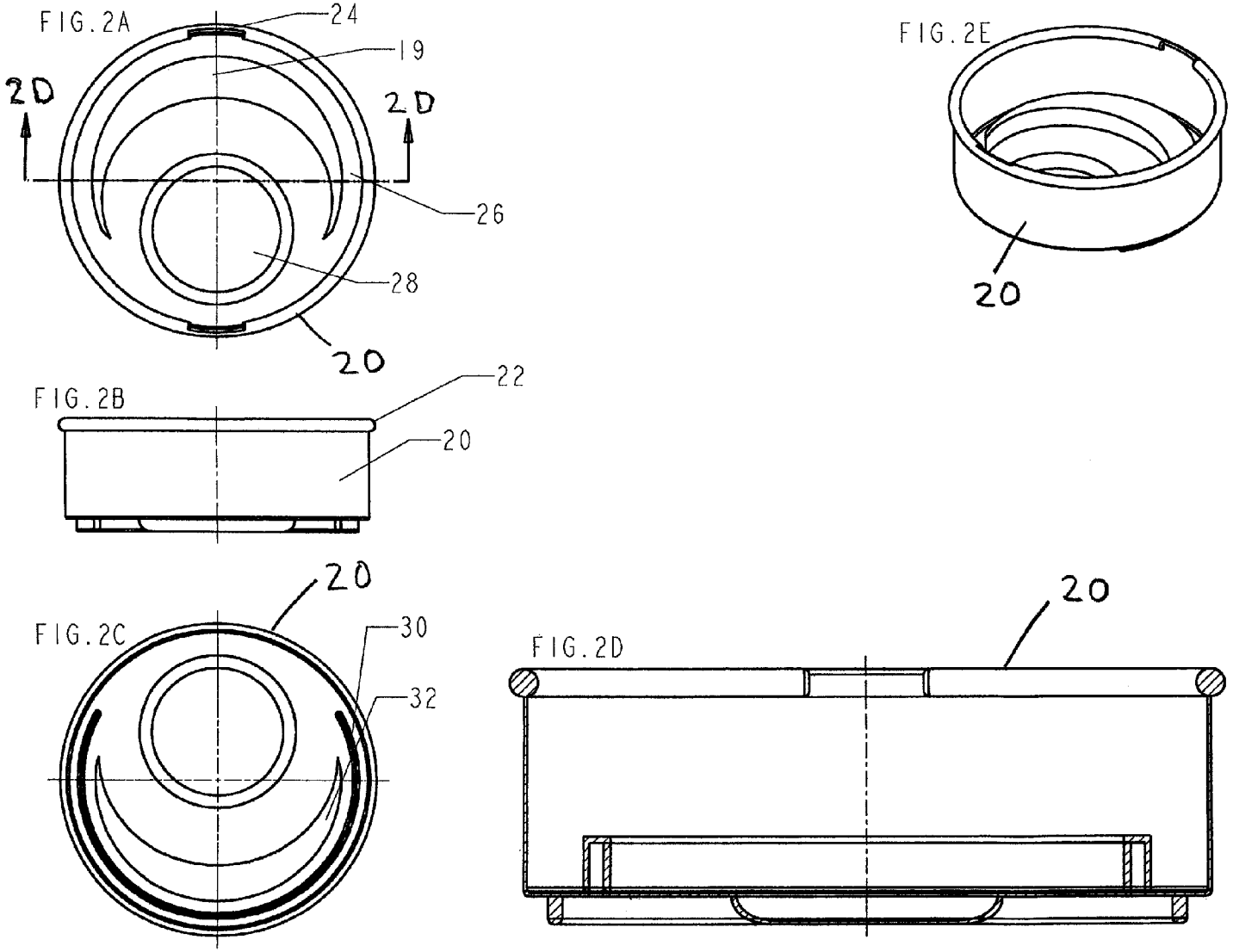
FIG. 2A is a top view of an outer container of a solid and liquid separating device in accordance with the present invention.
FIG. 2B is a front view of an outer container of a solid and liquid separating device in accordance with the present invention.
FIG. 2C is a bottom view of an outer container of a solid and liquid separating device in accordance with the present invention.
FIG. 2D is a cross sectional side view of an outer container of a solid and liquid separating device cut through FIG. 2A in accordance with the present invention.
FIG. 2E is a perspective view of an outer container of a solid and liquid separating device in accordance with the present invention.
Figure 3B:
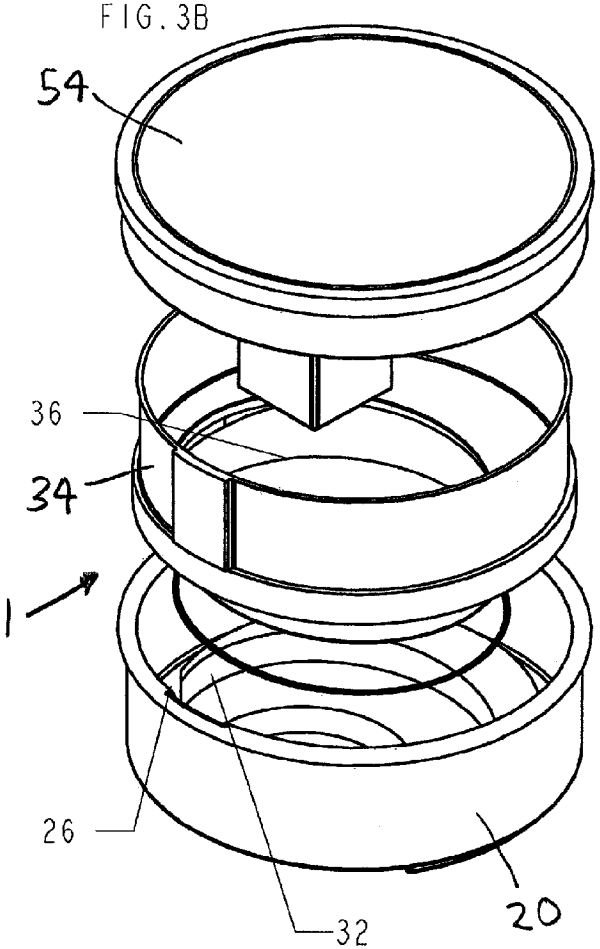
FIG. 3B is an exploded perspective view of a solid and liquid separating device in accordance with the present invention.
Figure 3A:
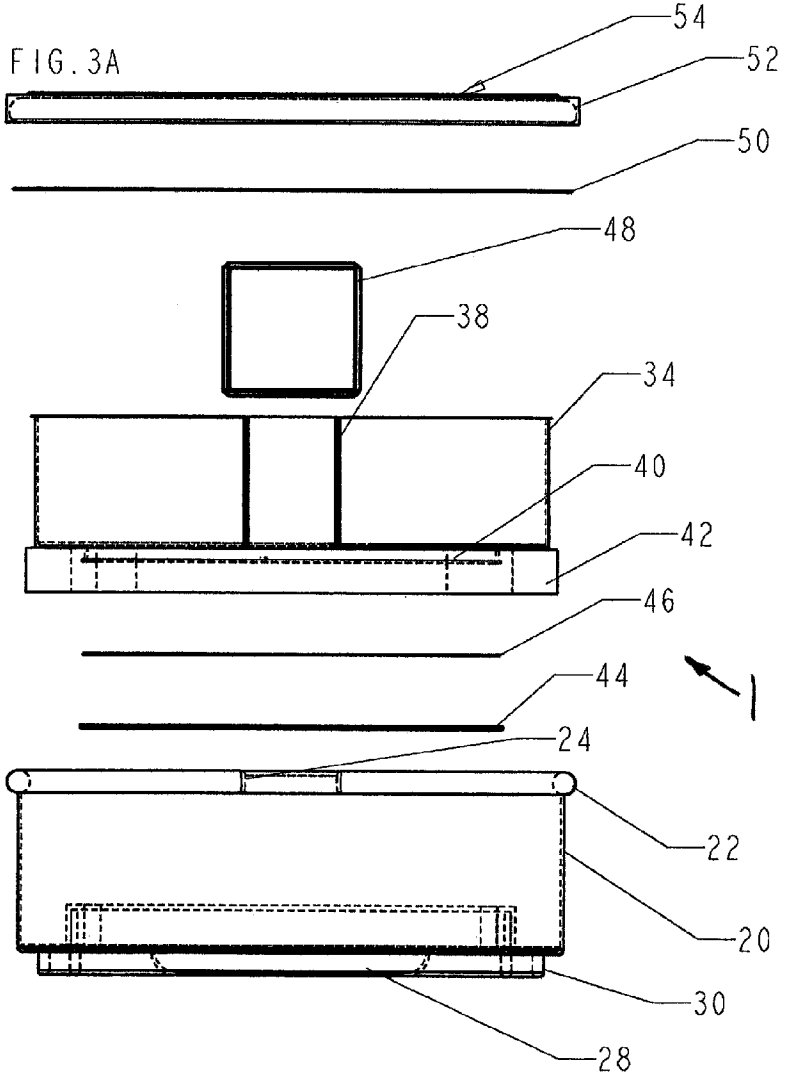
FIG. 3A is an exploded front view of a solid and liquid separating device in accordance with the present invention.
Figure 4D:
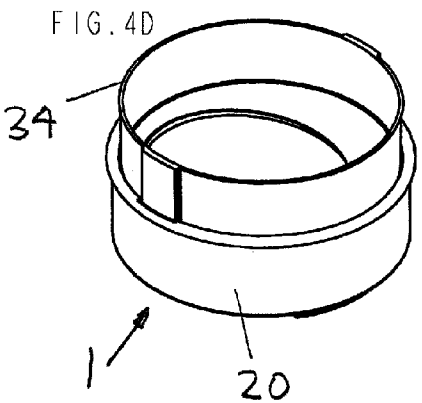
FIG. 4D is a perspective view of a solid and liquid separating device with an elevated inner container in accordance with the present invention.
Figure 4C:
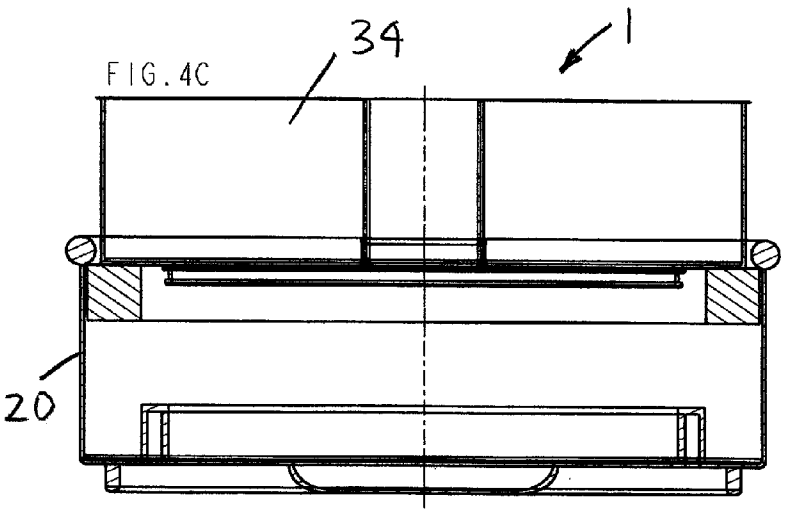
FIG. 4C is a cross sectional front view of a solid and liquid separating device with an elevated inner container cut through FIG. 4A in accordance with the present invention.
Figure 4A:
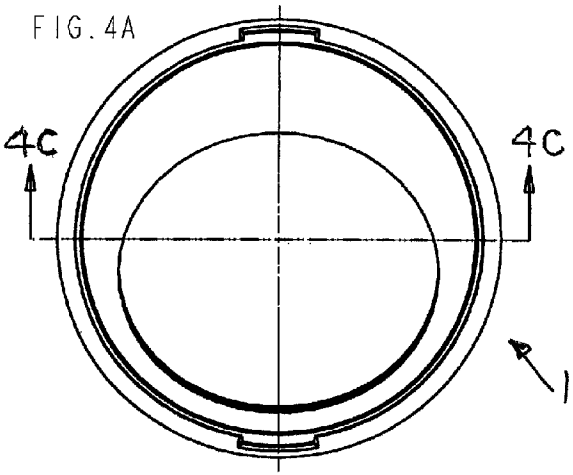
FIG. 4A is a top view of a solid and liquid separating device with an elevated inner container in accordance with the present invention.
Figure 4B:
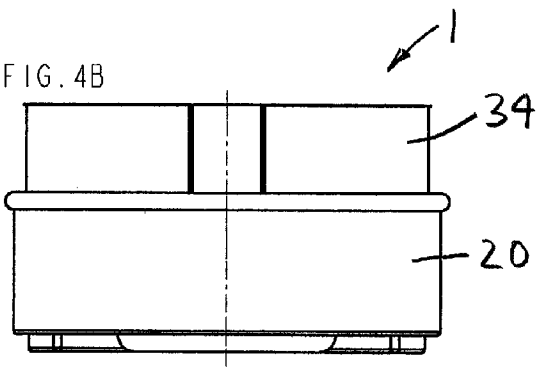
FIG. 4B is a front view of a solid and liquid separating device with an elevated inner container in accordance with the present invention.
Figure 5D:
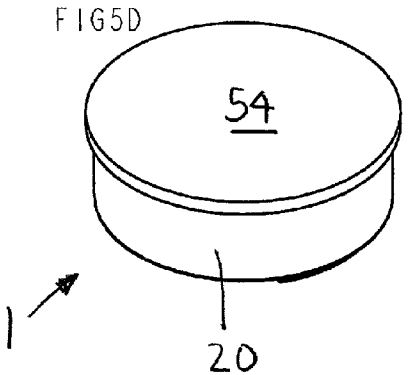
FIG. 5D is a perspective view of a solid and liquid separating device in accordance with the present invention.
Figure 5C:
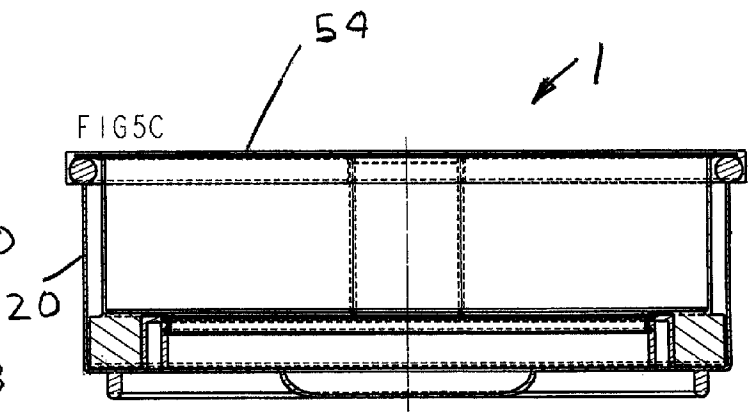
FIG. 5C is a cross sectional front view of a solid and liquid separating device cut through FIG. 5B in accordance with the present invention.
Figure 5B:
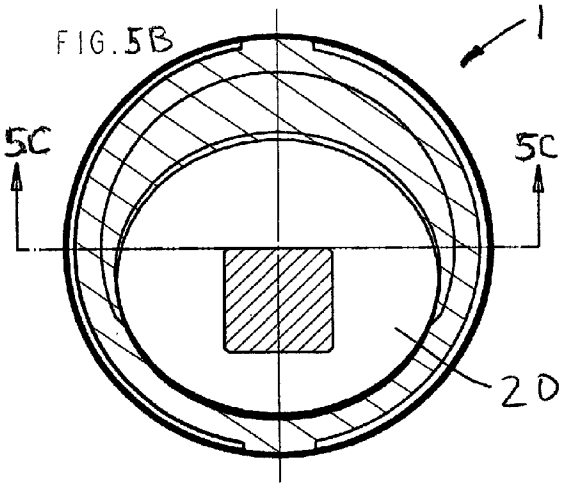
FIG. 5B is a top view of a solid and liquid separating device cut through FIG. 5A in accordance with the present invention.
Figure 5A:
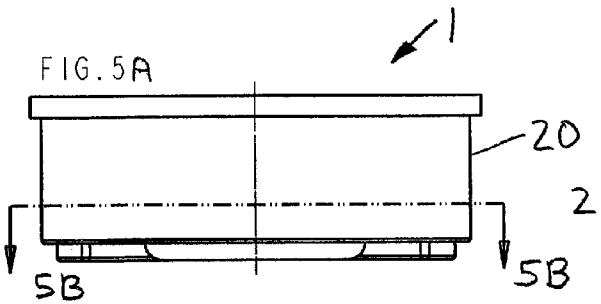
FIG. 5A is a front view of a solid and liquid separating device in accordance with the present invention.

With reference now to the drawings, and particularly to FIG. 3B, there is shown a perspective view of a solid and liquid separating device 1. With reference to FIGS. 1A-1E, an elliptical opening (hole) 36 passes through a bottom of the inner container 34. The hole 36 may have the shape of an oval, circle, an octagon or any other suitable shape. The elliptical opening 36 can also be different sizes. It may also cover an entire bottom of the inner container 34 up to a float ring/stop 42. The overlapping float ring/stop 42 extends from a bottom of the inner container 34.

An elliptical flange 40 follows the contour lines of the elliptical opening 36. The elliptical flange 40 is preferably molded to the elliptical opening 36 that passes through the inner container 34. However, other attachment methods may also be used, such as pressing or sealing the elliptical flange 40 in place. The elliptical flange 40 will protrude downward preferably between ⅛" to ¼". It is preferable to fabricate the elliptical flange 40 from the same material as the inner container 34 and the float ring/stop 42. However, other optimal materials may also be used. The elliptical flange 40 is preferably constructed using vertical or concaved walls and must contain a flange around the lower edge. A slight cutout 43 may be needed in the float ring/stop 42 to allow access to the elliptical flange 40. The cutout 43 must be as slight as possible.

Two projections 38 are located on the front side and rear side of the inner container 34. The two projections 38 extend from the float ring/stop 42 to the top of the inner container 34. The two projections 38 may be any suitable size or shape. It is preferable to mold the two projections 38 as a integral portion of the inner container 34. The two projections 38 are preferably located and centered on the vertical axis line 19. The projection 38 is used to keep the inner container 34 from rotating.

With reference to FIGS. 2*a*-2E, an outer container 20 is round with vertical sides. However, other shapes such as oval, rectangle, square, ellipse or pentagon may also be used. The outer container 20 is sized to receive the inner container 34. The outer container 20 should be slightly larger in diameter. It is preferable to fabricate the outer container 20 from a light disposable plastic. The outer container may also be fabricated from paperboard; heavier, more permanent plastic; aluminum; rubber; glass; fiber; wood; netting; screening; woven material or any other suitable material.

The sides of the outer container 20 are preferably straight, but could be concave, slanted, sloped, rounded or any other suitable shape. A lip/stop 22 preferably includes a round cross-section. The lip/stop 22 attached to an upper edge of the outer container 20. However, it is preferably to form the lip/stop 22 as an integral portion of the container 20 through an injection molding process or the like. The lip/stop 22 may be hollow or solid. It may also be made from other materials, and shapes such as rubber, heavier plastic, aluminum, glass, foam, paper, wood or any other suitable material. It may be assembled as a separate piece, and it may be round, oval, square, elliptical, etc. The lip/stop 22 will run 360° around the outer container 20.

A notch 24 is formed a vertical center axis line 19. The depth of this notch will be flush with the inner wall of the outer container 20. The inner perimeter of the notch 24 will be slightly longer than a perimeter of the projection 38. A half moon projection 32 extends from a bottom of the outer container 20. An inner arc of the half moon projection 32 will follow the arc of the elliptical opening 36. This arc will stay flush with the contoured arc of the elliptical opening 36. An outer arc of the half moon projection 32 will be located in from the interior wall of the outer container 20. The arc will stay contoured with the interior wall and will form a track 26. The track 26 is defined by the perimeter of the inner wall of the outer container and the outer arc of the half moon projection 32.

A recessed area 28 is found along the vertical axis line 19. An outer most circumference of the recessed area 28 is preferably ½" in from the inner wall of the outer container 20. The recessed area 28 is preferably ¼" deep and may be rounded on the edges. An arc leg 30, in its preferred state, follows the same shape of the outer container 20. Its location is preferably inward ¼" from the edge or as desired. The arc leg 30 is formed on the exterior of the outer container 20 and is preferably ¼" high or the same as the depth of the recessed area.

With reference to FIGS. 3A-5D, a stretch band 44 must be able to stretch at least to 5," while still having a good retractable tension and grip. The stretch band 44 is made from a nontoxic material, such as a suitable plastic. However, other materials may also be used, such as rubber, poly, fabric, nylon or like. A liquid permeable membrane 46 preferably stretches between 1½" to 2" per 5" diameter. The liquid permeable membrane may be fabricated material from nylon, spandex, cloth, rubber, netting, webbing or the like. The liquid permeable membrane must also be nontoxic. A spacer 48 can be made from almost any material such as light plastic, paperboard, netting, webbing or the like. A large, airtight seal 50 is preferred for this embodiment. The seal 50 may be made from materials such as plastic, metal, fiber, or other suitable material.

A lid 52 is preferably fabricated from a light plastic and is sized to receive and secure to the lip/stop 22. The lid 52 preferably includes a ridge 54 encircling the upper exterior surface. The ridge 54 is used for stacking purposes. The inner container 34 is used to retain solids. The solids can be foods such as cereal or pudding, yet not excluding other items. The solids will be prepackaged in the inner container 34. The inner container 34 will float the food on a liquid in the outer container 20. As the liquid is removed the level of the inner container 34 will drop. The float ring/stop 42 enables the inner container 34 to float on the liquid in the outer container 34. An edge of the float ring/stop 42 is squared allowing it to float sooner, with less drag, than if it were round.

The elliptical flange 40 extends from the elliptical opening 36. The elliptical flange 40 is used to retain the liquid permeable membrane 46 over the elliptical opening 36. The liquid permeable membrane 46 is stretched over the elliptical flange 40. The liquid permeable membrane 46 prevents solids such as cereal, pudding, or various other items from falling through the elliptical opening 36 into the liquid in the outer container 20. The liquid permeable membrane 46 allows a utensil to be inserted into liquid below the permeable membrane 46. The utensil (spoon) then draws the liquid, which combines with the solid. The liquid permeable membrane 46 then retracts back to its original form, once again keeping the solids away from the liquid.

The stretch band 44 firmly affixes the liquid permeable membrane 46 to the elliptical flange 40 allowing the elliptical opening 36 to be permanently covered. The outer container 20 is filled by the consumer with liquids such as milk, juice, water or the like. A recessed area 28 is located on the bottom of the outer container 20. The recessed area 28 allows liquid to pool in the lowest area for easy final consumption. The recessed area dips to preferably ¼" deep and can be rounded on the edges for easy access. An arc leg 30 is preferably ¼" in depth or the same depth as the recessed area. The arc leg 30 allows the inner container 34 to remain level.

The half moon projection 32 is hollow underneath when looking at the outer container 20 from the bottom. The half moon projection 32 is used to take up volume in the outer container 20. The half moon projection 32 allows quantities of solids in the inner container 34 to be more equal to quantities of the liquids in the larger outer container 20. This all stems from liquids occupying less space than the solids. When the solid and liquid separating device 1 is assembled, the float ring/stop 42 will be inserted into the track 26. The lip/stop 22 also adds rigidity to the outer container 20.

The spacer 48 is used especially for cereal. When the spacer 48 is removed, the quantity of cereal lowers in that specific area. This allows an access hole for easier access to the milk. The spacer 48 may be many shapes such as square, round, oval, ellipse, pentagon or any other suitable shape. The removable spacer 48 may resemble such things as a building block, a Chinese word, a letter of the alphabet, or many other learning tool novelties. The size of the spacer 48 can be adjusted according to the quantity of substance per container.

A flavoring bag may be added as an extra purchase incentive. The flavoring bag may be pre-packaged or later inserted into the outer container 20. The flavoring bag would lie on the bottom and soak up milk. The substance in the flavoring bag would flavor the milk. The flavoring bag would be made of a filter type material. It may contain condensed substances such as dried fruits, ground and powdered cereal, or other special additives for milk flavoring. This will create an added incentive for the purchase of the solid and liquid separating device 1. A powered milk pack can also be offered with this embodiment. This can be offered for campers, vacationers or people on the go. The seal 50 is used to seal the lid 52 to the lip/stop 22. The lid 52 is optional, but can be helpful for appearance, strength for shipping, and stacking, while storing on a shelf.

The solid and liquid separating device has numerous advantages:

(a) The solid/liquid separation device will be affordable.
(b) Foods can be eaten at a slower pace with a lasting crunch.
(c) Interruptions during a meal won't cause loss of meal or appetite, through loss of crunch.
(d) Money can be saved through less wasting of soggy food.
(e) Meals will taste better.
(f) Foods can be savored and eaten at a leisurely pace, eliminating stress during mealtime.
(g) Children can finish their food at their own pace.

Accordingly, the reader will see that various embodiments of the solid and liquid separating device can be used in granting a consumer the ability to eat at his or her own leisurely pace. This device allows interruptions at mealtime with no regrets of soggy cereal or runny pudding. In addition, every bite will taste fresh, just like the first. Furthermore, the solid and liquid separating device can be made mobile:

- it can be taken on camping trips or vacations.
- it can be sent to daycares or schools.
- it can be used by our troops in the military or our hospitals.
- it can be offered as an incentive in our travel industry (truck stops, airlines, train depots, hotels, etc.).
- it can also be offered in supermarkets, company lunch rooms, cafeterias, restaurants, and vending machines.

Although the description above gives many specific details, these should not be considered as limiting toward the scope of the embodiments but as merely providing a better look into some of the presently preferred embodiments. For example, the inner and outer container can be almost any shape (Circle, square, triangle, etc.). They can be any size (small, medium, or large). The sides can be different shapes such as vertical, sloped, straight, concave, slanted, curved, etc. The containers can be made from numerous materials (disposable plastic, paperboard, more permanent plastic, or many others). Various colors can be used (translucent, clear, opaque, primary, secondary or intermediate colors). The lip/stop is optional and can be various shapes (round, flat, square, curved etc.). It can go all the way around the container or it can be in partial sections resembling tabs. Its material and color can be the same or different from the outer container. The notch is optional depending on the shape of the container and can be various shapes (round, square, rectangle, etc.). It can be located in different places such as on the lip/stop or on the inside of the outer container. The notch can be a protrusion on the inside of the outer container or an extrusion on the inside of the outer container.

The elliptical opening can be any shape or size and can span up to the entire size of the inner container's bottom. The shape of the elliptical flange is optional and may follow the contour line of the elliptical opening. It can be any color. The track is formed by the half moon, which is optional. The half moon's shape can be altered to any shape. The float ring/stop can be designed in different ways. It can be a complete circle, a broken circle, or a filled in circle, as long as milk can pass through. It can be other shapes as well and will generally follow the shape of the container. The float ring/stop can be optional if the inner container is light weight and is made with a floatable bottom, capable of floating its contents. The recessed area is optional.

Its shape can vary (oval, ellipse, semi-circle, etc.). Rounded edges on the recessed area are optional. Various depths, colors and materials can be used. The arc leg is optional. It can be various lengths, colors, materials, and shapes. Its depth should be the same or higher than the recessed area allowing the bowl to sit level or tilt forward. It can be molded, glued, fused, etc. to the bottom of the outer container. The stretch material should be able to stretch and return to its original form repeatedly. It can be any color. It can be made from any stretchable material (spandex, rubber, nylon, etc.). The stretch band should be made from a material that is non-toxic (nylon, rubber, plastic, etc.). It can also be replaced by a snap-ring. The spacer is optional and is used to regulate the quantity per serving. It can be any shape or size. It can be a teaching tool or a novelty item. (die, domino, ball, cube, pyramid, word from Chinese language, etc.). It can be made light-weight from plastic or various materials.

The seal can be large enough to fit over the lip/stop, making the entire embodiment air-tight. Two seals may also be used. One can fit over the inner container and the other over the float ring/stop, making the inner container and contents air-tight. The seal can be made from foil, plastic or other tough materials.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A solid and liquid separating device comprising:

an inner container having a liquid opening in a bottom thereof, a liquid permeable membrane is attached to said inner container, said liquid permeable membrane covering said liquid opening; and an outer container being sized to receive an outer perimeter of said inner container, wherein said inner container containing a plurality of solids, said outer container containing a liquid, said inner container floating on the liquid, said liquid permeable membrane is depressed into said outer container to allow liquid to enter said inner container, the liquid does not enter said inner container when said liquid permeable membrane is not depressed.

2. The solid and liquid separating device of claim 1, further comprising:

at least one projection extends from a wall of said inner container, at least one notch is formed in a wall of said outer container to receive said at least one projection.

3. The solid and liquid separating device of claim 1, further comprising:

a recessed area is formed in a bottom of said outer container.

4. The solid and liquid separating device of claim 1, further comprising:

a spacer is placed over said liquid permeable membrane, the plurality of solids being placed around said spacer.

5. The solid and liquid separating device of claim 1, further comprising:

a lip is formed on an open end of said outer container.

6. The solid and liquid separating device of claim 1, further comprising:

a float ring extends from a bottom of said inner container.

7. The solid and liquid separating device of claim 1, further comprising:

said liquid permeable membrane is elastic.

8. A solid and liquid separating device comprising:

an inner container having a liquid opening in a bottom thereof, a liquid permeable membrane is attached to said inner container, said liquid permeable membrane covering said liquid opening;

a float ring extends from a bottom of said inner container; and an outer container being sized to receive an outer perimeter of said inner container, wherein said inner container containing a plurality of solids, said outer container containing a liquid, said inner container floating on the liquid, said liquid permeable membrane is depressed into said outer container to allow liquid to enter said inner container, the liquid does not enter said inner container when said liquid permeable membrane is not depressed.

9. The solid and liquid separating device of claim 8, further comprising:

at least one projection extends from a wall of said inner container, at least one notch is formed in a wall of said outer container to receive said at least one projection.

10. The solid and liquid separating device of claim 8, further comprising:

a recessed area is formed in a bottom of said outer container.

11. The solid and liquid separating device of claim 8, further comprising:

a spacer is placed over said liquid permeable membrane, the plurality of solids being placed around said spacer.

12. The solid and liquid separating device of claim 8, further comprising:

a lip is formed on an open end of said outer container.

13. The solid and liquid separating device of claim 8, further comprising:

said liquid permeable membrane is elastic.

14. A solid and liquid separating device comprising:

an inner container having a liquid opening in a bottom thereof, a liquid permeable membrane is attached to said inner container, said liquid permeable membrane covering said liquid opening;

a spacer is placed over said liquid permeable membrane, the plurality of solids being placed around said spacer; and an outer container being sized to receive an outer perimeter of said inner container, wherein said inner container containing a plurality of solids, said outer container containing a liquid, said inner container floating on the liquid, said liquid permeable membrane is depressed into said outer container to allow liquid to enter said inner container, the liquid does not enter said inner container when said liquid permeable membrane is not depressed.

15. The solid and liquid separating device of claim 14, further comprising:

at least one projection extends from a wall of said inner container, at least one notch is formed in a wall of said outer container to receive said at least one projection.

16. The solid and liquid separating device of claim 14, further comprising:

a recessed area is formed in a bottom of said outer container.

17. The solid and liquid separating device of claim 14, further comprising:

a lip is formed on an open end of said outer container.

18. The solid and liquid separating device of claim 14, further comprising:

a float ring extends from a bottom of said inner container.

19. The solid and liquid separating device of claim 14, further comprising:

said liquid permeable membrane is elastic.

* * * * *